United States Patent [19]

Smith et al.

[11] 4,304,048

[45] Dec. 8, 1981

[54] RADIO FREQUENCY DRYING OF TEXTILE MATERIAL

[75] Inventors: Geoffrey A. Smith, Jedburgh; Thomas F. McAuley, Tweedbank, both of Scotland

[73] Assignee: Dawson International Limited, Scotland

[21] Appl. No.: 176,210

[22] Filed: Aug. 7, 1980

[30] Foreign Application Priority Data

Aug. 8, 1979 [GB] United Kingdom ..... 27700/79

[51] Int. Cl.[3] ..... F26B 23/08

[52] U.S. Cl. ..... 34/1; 34/92; 34/105; 34/68; 34/54; 219/10.57

[58] Field of Search ..... 219/6.5, 10.57, 10.81; 34/15, 21, 1, 68, 104, 105, 92, 54

[56] References Cited

U.S. PATENT DOCUMENTS 3,045,358 7/1962 Breakell et al. ..... 34/105

FOREIGN PATENT DOCUMENTS 2299443 8/1976 France .

*Primary Examiner*—L. I. Schwartz

*Attorney, Agent, or Firm*—Parmelee, Miller, Welsh & Kratz

[57] ABSTRACT

Textile material to be dried is mounted in an apparatus on a plurality of supports (1). The supports are moved along a predetermined path, and suction and radio frequency energy are applied to the material, to dry it.

A pump (10*a*) which can pump both liquid and vapor draws air through the material to remove water. A valve (12) is associated with the suction duct (2) leading to each support, and these valves are adjusted as the supports move along the path, so that a maximum amount of suction is applied to the wet material and a lesser amount of suction to the drier material.

11 Claims, 6 Drawing Figures

RADIO FREQUENCY DRYING OF TEXTILE MATERIAL

This invention relates to an apparatus for and a method of radio frequency drying of textile materials. The textile material will normally, but not always, be in the form of yarn wound onto a bobbin to form a package.

In conventional yarn processing, the yarn is dyed in a bath of dye liquor, and after dying the excess dye is rinsed from the yarn. At this stage, the yarn is very wet, and the yarn package may have a moisture content of up to 200%. The wet yarn is centrifuged or hydroextracted to remove the liquid water from the yarn package. This reduces the moisture content to something below 50%.

The package is then passed to a drying machine. Drying machines working on various principles are in use at the present time. Some of these use the radio frequency method for driving out the water from the yarn, and one such apparatus is described in French patent specification No. 2,299,443. In the French specification, the moist packages are exposed to radio frequency energy, which raises the temperature of the water which they contain. At the same time, air is sucked through the yarn, and the water is removed as water vapour through a vacuum pump.

According to the present invention, there is provided apparatus for drying textile material, the apparatus comprising a plurality of supports for supporting the material, means for moving the supports along a predetermined path, a suction duct associated with each support, a suction pump arranged to suck air through the material via the ducts to remove vapour and liquid from the material, a valve associated with each duct, each valve being adjustable to alter the flow cross-section through the duct, means arranged along said predetermined path and adapted to adjust the opening of each valve at predetermined positions along the path, and means for applying radio frequency energy to the material as it passes along the path.

Such an apparatus has advantages over the prior art in that it is capable of accepting packages having a moisture content of up to 200% i.e. directly from the dye bath, and drying these to the final desired moisture content. This is possible because the pump is of a type which can pump both liquid and gas. In a preferred embodiment, the pump is a liquid ring pump.

Furthermore, the applicants experiments have shown that the permeability of yarn packages to air varies remarkably on their moisture content. A very wet package has a much greater resistance to air flow through it than a dry package. The use of adjustable valves along the path of travel of the supports means that a single pump can service all of the supports carrying packages, by adjusting the valves associated with dry or nearly dry packages so that they are practically closed, and leaving the valves associated with wet packages fully open so that the suction power is directed to the wet packages.

The invention also provides a method of drying textile material, wherein material is loaded continuously to an apparatus, suction is initially applied to the material to remove liquid water, and the material is then moved through a dielectric field while the suction continues to be applied, the amount of suction applied to the material being reduced as the material passes further through the field and becomes drier.

The invention will now be further described, by way of example, with reference to the accompanying drawings, in which.

Figure 1:
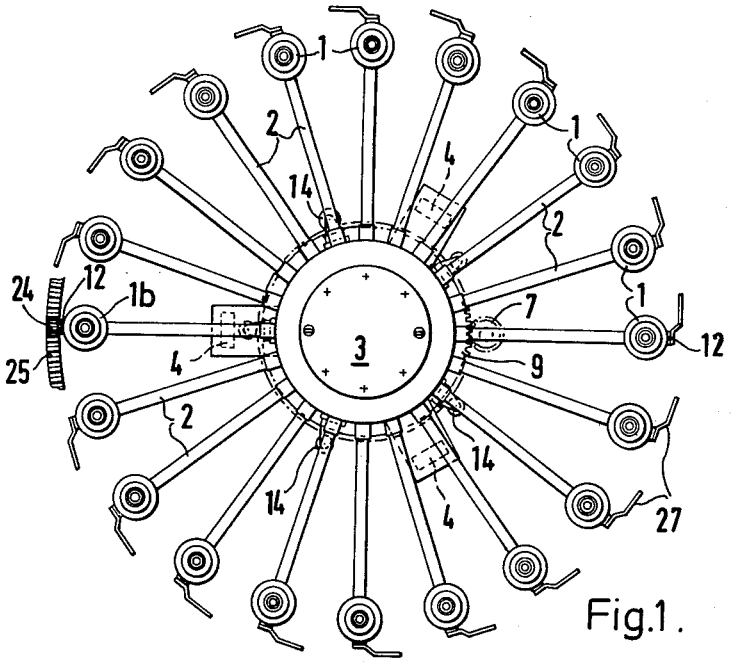
FIG. 1 is a plan view of part of an apparatus according to the invention.
Figure 2:
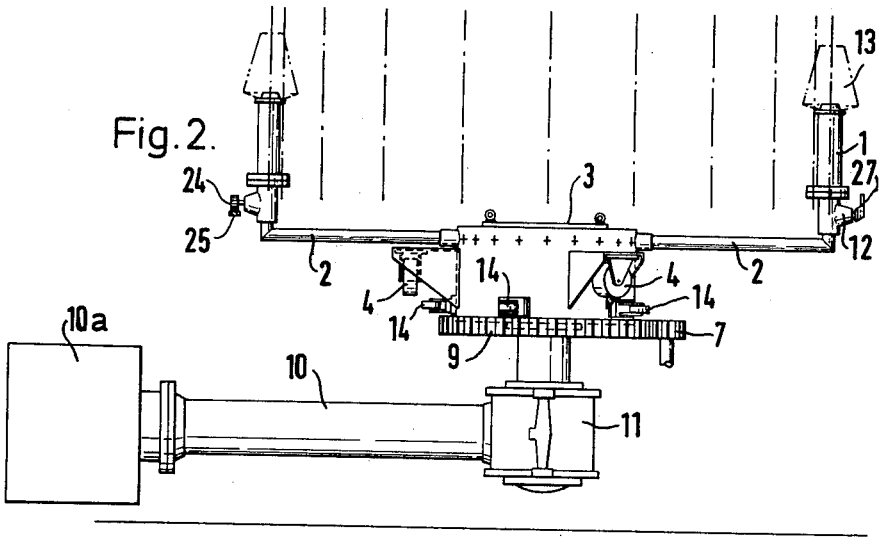
FIG. 2 is a side view of the apparatus part shown in FIG. 1 with only two of the package supports shown in detail.

FIG. 1 shows a carousel with a plurality of package supports 1 positioned at the end of arms 2. The arms 2 are connected to a central turntable 3 which is supported by means of wheels 4 on a table 5 and is driven in rotation by means of a motor 6 driving a pinion 7 through a transmission 8. The pinion 7 meshes with a gear wheel 9 which is fast with the turntable 3 (see FIG. 5). The supports 1 are thus driven around a circular path.

Below the turntable 3 there is a suction pipe 10 connected to a liquid ring suction pump (10*a*). The pipe 10 communicates via a rotary joint 11 and the interior of the turntable 3 with the arms 2 which are hollow, and with the supports 1 which are also hollow. A valve 12 is provided for each support 1. Yarn packages 13 are placed on each support 1. The packages 13 are wound on perforated bobbins, and the top end of each bobbin is closed. When suction is applied by the suction pump through pipe 10, arms 2 and supports 1, air is drawn in through the yarn on the package down through the supports 1, arms 2 and turntable 3 and out via the suction pipe 10. The liquid ring pump 10*a* which is used is of a type which will pump both liquid and gaseous media, and so both vapour and liquid water which are sucked out of the packages 13 by the air flow through the packages can be removed by the pump. The valves 12 can be adjusted in a manner which will be described later, to vary the flow cross-section through the support 1 and thus to control the degree of suction through each individual package 13. The turntable 3 is maintained centrally within the housing by means of roller 14 with vertical axes which run against an upwardly directed flange 15 below the table 5.

Figure 3:
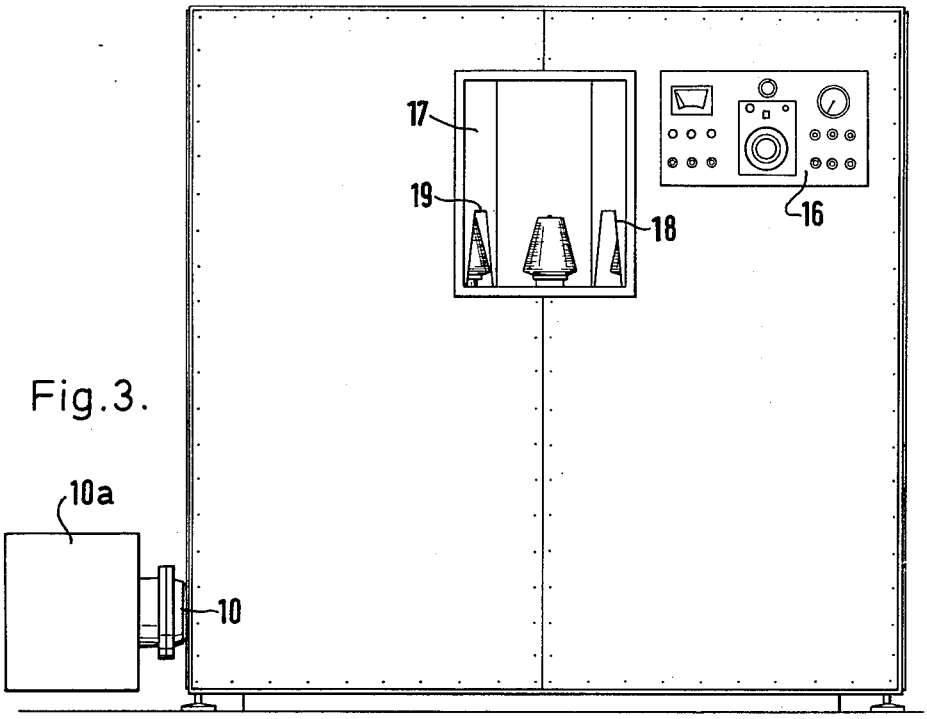
FIG. 3 is a front view of the exterior of the apparatus.

FIG. 3 shows the exterior of the apparatus from the front with a control panel 16 and a loading/unloading bay 17. At one part of the circular path along which the packages travel, they pass through the bay 17, entering the bay through an opening 18 and leaving it from an opening 19. There may be swing doors (not shown) associated with the openings 18 and 19 which are actuated by the passage of the packages in order to enclose the interior space of the apparatus. In this bay, when the carousel is turning in a clockwise direction, dried packages will emerge from the opening 18, be removed from the apparatus, and wet packages will be placed on the spindles thus vacated to travel through the opening 19 into the interior space of the apparatus. The suction pump 10*a* is shown at the bottom left hand corner of the housing.

Figure 4:
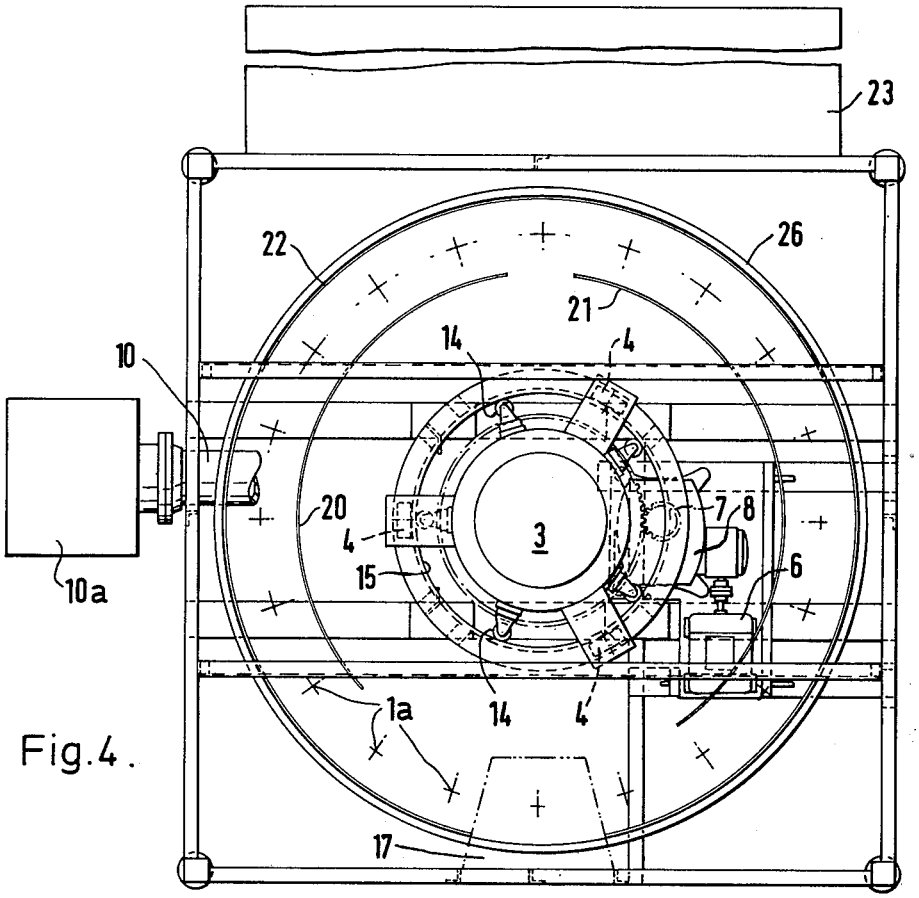
FIG. 4 is a plan view of the apparatus with a top housing panel removed.

In FIG. 4, the arms 2 and details of the carousel have been omitted, but the positions of the supports 1 have been indicated by crosses 1*a*. Around the circular path along which the supports travel, electrodes are arranged. On the inner side of the path there are two electrodes 20 and 21. On the outside of the path, there is one electrode 22. The inner electrodes 20, 21 are live and the outer electrode is earthed. A radio frequency generator 23 mounted at the back of the housing energizes the electrodes, so that electro-magnetic waves travel from the live electrodes to the earth electrode via the packages arranged between the electrodes, which form a dielectric. Using a known effect, the water contained in the packages is heated by the radio frequency energy, and when air is drawn through the packages 13 by the suction pump, water vapour is displaced.

The inner electrodes 20 and 21 may conveniently be suspended from the roof of the housing, while the outer electrode 22 can be attached directly to the wall of the housing.

Two alternative ways of controlling the valves 12 as the carousel rotates are proposed. A first, and preferred, way is indicated on the lefthand side of FIG. 1. As shown on the support 1*b*, a pinion 24 is mounted on a control shaft of the associated valve 12. Around the path of the supports 1, a rack 25 is mounted. The position of this rack is indicated at 26 in FIG. 4. The rack 25 will be divided into sections around the circumference of the carousel, and different sections can be raised so that they are in a position to act upon the pinions 24, or lowered so that they have no effect on the pinions 24. When a section of the rack 25 is raised, and a pinion 24 comes into contact with it, the valve will be gradually closed as the pinion rotates along the length of the rack.

Figure 5:
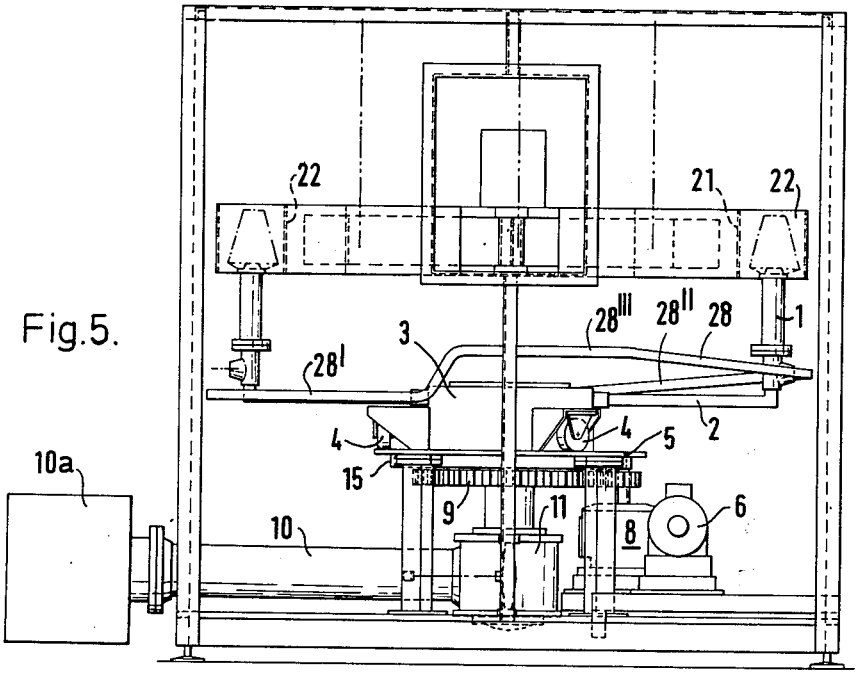
FIG. 5 is a front elevation of the apparatus with the front housing panel removed.
Figure 6:
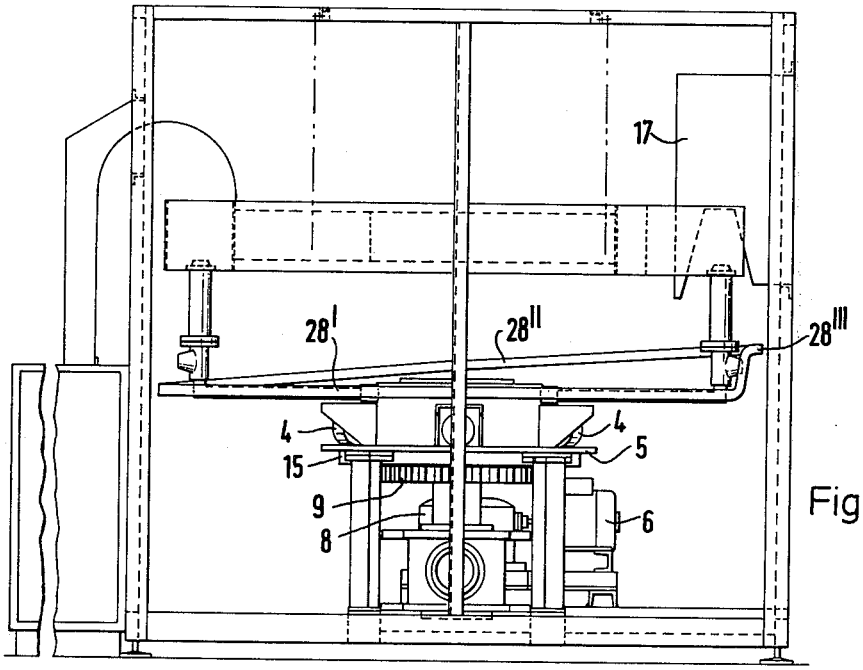
FIG. 6 is a side elevation of the apparatus again with a housing panel removed.

The alternative proposed method of actuating the valves 12 is best described with reference to FIGS. 1 and 5. In this alternative, each valve 12 has a control handle 27 with a cam follower at its outer end. The cam followers follow a control rail 28 around the circumference of the path of the supports. As can be seen in FIG. 5, the profile of the rail 28 will cause the handles 27 to be turned as each support moves around the apparatus. FIG. 5 is a front view, and the part 28' of the rail 28 is where the wet packages are inserted. When the cam follower follows portion 28' of the rail, the valve will be fully open and maximum suction will be available. After about half way round the apparatus, the cam rail 28 starts to rise at 28'', and the valves 12 start to close. When the straight portion 28'' is reached, the valve is fully closed.

The operation of the apparatus will now be described.

The speed of the carousel will depend on the nature of the material being dried, and also on its moisture content. However the speed is likely to vary between one revolution per minute and one revolution per 30 minutes.

Loading and unloading of the wet and dry packages can be done manually or automatically. When this is done manually, an operator will doff a dry package coming out of the opening 18 into the loading bay 17, and will immediately place a wet package on the support 1 which thus becomes vacant. The newly positioned wet package then passes on through the opening 19 into the apparatus. This operation could easily be automated by providing a known doffing mechanism for removing the dry packages, and providing a hopper communicating with the loading bay 17 for placing wet packages on the supports.

It can be seen from FIG. 4 that the wet packages do not immediately become subject to radio frequency energy. They travel through about 20° of arc from the loading bay 17 before they reach the electrode 20. In this initial arc, the wet packages are subjected to a high degree of suction, and most of the free moisture is sucked off as liquid.

The packages then travel on to a position between the electrodes 20 and 22, and the radio frequency energy begins to raise the temperature of the moisture in the packages. The suction continues, and water vapour is drawn off the packages through the arms 2 and suction pipe 10.

Once the packages have traversed about half of the circular path, most of the drying has taken place and it is much easier for air to pass through the packages. Because only a single suction source is used, it is necessary to ensure that the suction is correctly distributed amongst the packages moving round the apparatus at any one time. Because air passes through the dry and almost dry packages much more easily than through the wet packages, in the absence of any valves, air would be sucked in at a large rate through the dry packages and at practically a nil rate through the wet packages. The valves 12 are therefore provided and are adjusted so that the valves underneath dry and almost dry packages are closed substantially more than those under wet packages, so that the suction is directed to the wet packages.

When the dry packages once again reach the bay 17, they are removed from the apparatus.

The radio frequency generator 23 is set to produce a frequency of 27.12 MHz. This is an internationally agreed radio frequency for dielectric apparatus. In order to obtain a good drying effect, and to facilitate tuning of the apparatus, two inner electrodes 20, 21 are used with one outer electrode 22.

Different drying conditions are required for different materials. The predominating drying condition is the maximum temperature to which the yarn can be raised. The main adjustment for altering the temperature to which the yarn is to be subjected is the speed of rotation of the carousel. Obviously, a package which goes round the entire path in one minute will reach a lower temperature than one which goes round in 30 minutes.

The alteration of vacuum around the apparatus also needs to be varied to suit different materials and sizes of packages. The amount of vacuum has a significant effect on the temperature, in that when a large volume of air is drawn through the package by the suction pump, the temperature of the package will be kept at a lower level than would otherwise be the case. Drying temperatures as low as 50° can be used.

Vacuum applied to packages entering the apparatus is not less than ten inches Hg, and this level of vacuum is sufficient to remove liquid water from the package before it enters the dielectric field. It is to be noted that packages can be loaded into the apparatus with 200% moisture content.

The supports 1 have to be insulating, and have to raise the packages above the carousel, so that the arms 2 do not interfere with the electrodes 20, 21, 22 as the carousel rotates. In the preferred embodiment, the supports 1 are hollow polypropylene tubes.

Further modifications envisage a variable number of supports on a carousel. A suction manifold could be continuous around the outer periphery of the carousel, and a desired number of supports could be plugged into the manifold, with unused manifold outlets being blanked off.

The height of the electrodes can be such that various heights of bobbins will be accommodated within the dielectric field.

It is envisaged that it could be possible to use half of a rotating machine such as that described, for dying, with the second half being used for drying. This would mean that undyed packages could be loaded into the machine and dyed, with dried and dyed packages unloaded at the other end. It would probably then be necessary to have a separate liquid exhaust system for the dye liquor.

The apparatus could easily be adapted to be controlled by a microprocessor. Programmes for different fibres could be used which would automatically control the vacuum, rate of rotation and thus temperature reached for any particular fibre. A temperature read out could be adopted, the temperature being based on experimental data acquired at the particular operating parameters.

The apparatus as described also helps with dye fixation in addition to the drying action.

The invention can be used to dry loose fibre, yarns (on packages, hanks or beams), tow, sliver, tops and cloth whether knitted, woven, tufted etc., and even carpets by arranging suction and radio frequency energy where the substrate is held under constraint by a suitably perforated device.

We claim:

1. Apparatus for drying textile material, the apparatus comprising a plurality of supports for supporting the material, means for moving the supports along a predetermined path, a suction duct associated with each support, a suction pump arranged to suck air through the material via the ducts, and means for applying radio frequency energy to the material as it passes along the path characterised in that the pump is adapted to remove vapour and liquid from the material, and that a valve is associated with each duct, each valve being adjustable to alter the flow cross-section through the duct, means being arranged along said predetermined path and adapted to adjust the opening of each valve at predetermined positions along the path.

2. Apparatus as claimed in claim 1, wherein the predetermined path is a circular path.

3. Apparatus as claimed in claim 2, wherein the means for moving the supports is a turntable, and the suction ducts comprise hollow arms which extend radially from the turntable and carry the supports at their radially outer ends.

4. Apparatus as claimed in claim 3, wherein the supports are hollow tubes mounted vertically at the radially outer ends of the hollow arms.

5. Apparatus as claimed in claim 1, wherein each said valve is a rotary action valve having an associated pinion, and said valve adjusting means comprises at least one rack section which is adapted controllably to engage the pinions for adjusting the opening positions of the valves when required in the course of movement of the supports along the predetermined path.

6. Apparatus as claimed in claim 1, wherein each said valve is a rotary action valve and said valve adjusting means is a stationary control rail of undulating profile extending around the predetermined path, with and by which follower members associated with the valves are engaged and caused to be moved to adjust the opening positions of the valves.

7. Apparatus as claimed in claim 2, wherein a loading and unloading bay is provided at one point of the circular path.

8. Apparatus as claimed in claim 7, the apparatus being arranged inside a housing, with swing doors being provided into and out of the housing on either side of the loading bay, which doors are operated by the material mounted on the supports.

9. Apparatus as claimed in claim 8, wherein an automatic device is provided at the loading bay for removing dried material, and placing material to be dried on the thus vacated supports.

10. Apparatus as claimed in claim 1, wherein the suction pump, the valve adjusting means and the means for applying radio frequency energy are arranged such that the material on a support is subjected to suction to remove liquid therefrom before radio frequency energy is applied thereto.

11. Apparatus as claimed in claim 1, including a microprocessor for controlling the operation of the means for moving the supports, the suction pump, the valve adjusting means and the means for applying radio frequency energy.

* * * * *